United States Patent [19]

Négre

[11] 4,074,748

[45] Feb. 21, 1978

[54] CENTRIFUGAL CASTING MACHINE HAVING A DEVICE FOR AXIALLY PLACING AND MAINTAINING A CORE IN POSITION

[75] Inventor: Robert Paul Négre, Fumel, France

[73] Assignee: Pont-A-Mousson S.A., Nancy, France

[21] Appl. No.: 627,816

[22] Filed: Oct. 31, 1975

[30] Foreign Application Priority Data

June 16, 1975 France ..... 75 18770

[51] Int. Cl.[2] ..... B22D 13/10

[52] U.S. Cl. ..... 164/292; 164/137; 164/302; 164/340

[58] Field of Search ..... 164/288, 292, 298, 302, 164/340, 137, 175, 286, 345, 180, 332, 334

[56] References Cited

U.S. PATENT DOCUMENTS

| | | | |
|---|---|---|---|
| 3,168,765 | 2/1965 | Bernhardt | 164/302 X |
| 3,412,785 | 11/1968 | Lorang | 164/292 |
| 3,612,162 | 10/1971 | Michel | 164/340 X |

*Primary Examiner*—Francis S. Husar
*Assistant Examiner*—Gus T. Hampilos
*Attorney, Agent, or Firm*—Sughrue, Rothwell, Mion, Zinn and Macpeak

[57] ABSTRACT

The machine comprises a housing, a casting mould rotatably mounted in the housing and a device for axially placing and maintaining a core against the end of the mould. The device comprises an element for urging the core against the mould, a releasable mechanism for fixing the core to the element and means for shifting the element between a position in which it urges the core against the mould and a withdrawn position. According to the invention, the mechanism is movable on the housing between a position in which it fixes the core to the element when the latter applies the core against the mould and a withdrawn position, the arrangement being such that the mechanism can follow, between its withdrawn position and its other position, the movement of the means for shifting the element. A return element is provided for returning the mechanism to its withdrawn position.

10 Claims, 8 Drawing Figures

CENTRIFUGAL CASTING MACHINE HAVING A DEVICE FOR AXIALLY PLACING AND MAINTAINING A CORE IN POSITION

The present invention relates to centrifugal casting machines of the type comprising a housing, a casting mould rotatably mounted in the housing and a device for axially placing and maintaining a core against the end of the mould, this device comprising a thrust element for urging the core axially against the mould, a releasable mechanism for fixing the core to the thrust element and means for shifting the thrust element between a position in which it urges the core against the mould and a withdrawn position.

Machines of this type are known for example from French Pat. No. 69 22 530 — 2,051,993, filed by the applicant, in which the releasable means for fixing the core to the thrust element is integral with the means for shifting the thrust element.

However, in such an arrangement, even when released, the mechanism for fixing the core to the thrust element encumbers access to the mould and renders extremely difficult a view of the cavity of the mould near to the socket end. Now, it is extremely important that the operator of the machine have a view which is as good as possible of the arrival of the material poured in the socket so as to be able to proceed in a precise manner to the initiation of the translation of the pouring means with respect to the mould.

An object of the present invention is to provide a machine which permits the best possible visibility inside the socket of the mould once the core has been applied against the mould by means of the thrust element.

According to the invention, there is provided a machine of the aforementioned type wherein the releasable mechanism for fixing the core is movably mounted on the housing between a first position in which it fixes the core to the thrust element when the thrust element applies the core against the mould, and a withdrawn second position, the arrangement being such that the mechanism can follow, between its withdrawn position and its first position, the movement of the means for shifting the thrust element, means being provided for returning the mechanism to its withdrawn position.

In this way, as soon as the means for shifting the thrust element have brought against the mould the core maintained on the thrust element by the fixing mechanism, the latter can be released with respect to the core and then rapidly returned by the return means to its withdrawn position in which it clears the cavity of the mould and therefore permits a good view of the cavity to be had.

Owing to this arrangement, it is also possible to mount in a particularly advantageous manner the thrust element to rotate about its axis with its fixing means. Thus, during casting, only the core rotates with the mould whereas the thrust element does not rotate, which has for important advantages to avoid splashing of droplets of centrifugated poured material and consequently improve safety, to simplify the mechanical construction and to render it less vulnerable to the iron by the absence of a rotating part beyond the core during the pouring.

In a particular embodiment of the invention, the thrust element is rotatable under the action of its shifting means between its two positions, about a pivot shaft perpendicular to the axis of rotation of the mould and disposed laterally with respect to the mould, and the releasable fixing mechanism is mounted to be freely rotatable about the same shaft. The return means is preferably constituted in this case by a counterweight. This arrangement is particularly simple from the mechanical point of view.

The invention is advantageously applicable to the production of centrifugal cast iron pipes having a socket.

Further features and advantages of the invention will be apparent from the ensuing description given solely by way of example with reference to the accompanying drawings.

Figure 1:
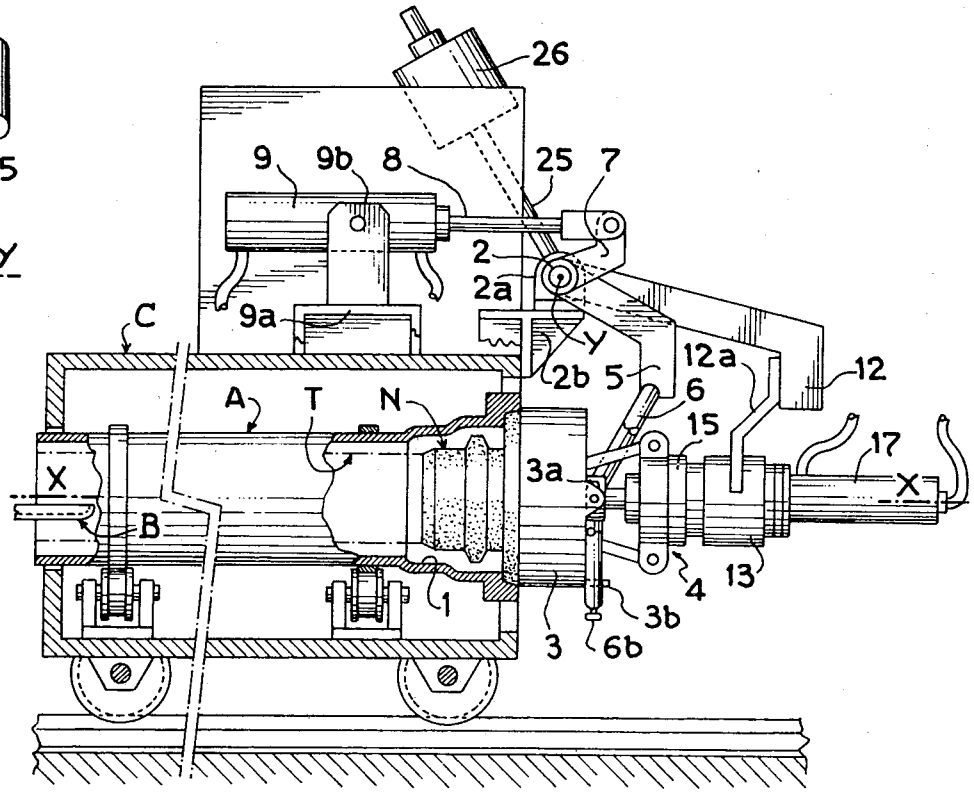
FIG. 1 is a diagrammatic elevational view, partly in section, of a machine for centrifugally casting pipes having a socket according to the invention in the position in which the assembly of the device for axially placing and maintaining the core against the mould is applied against the mould of the machine.
Figure 2:
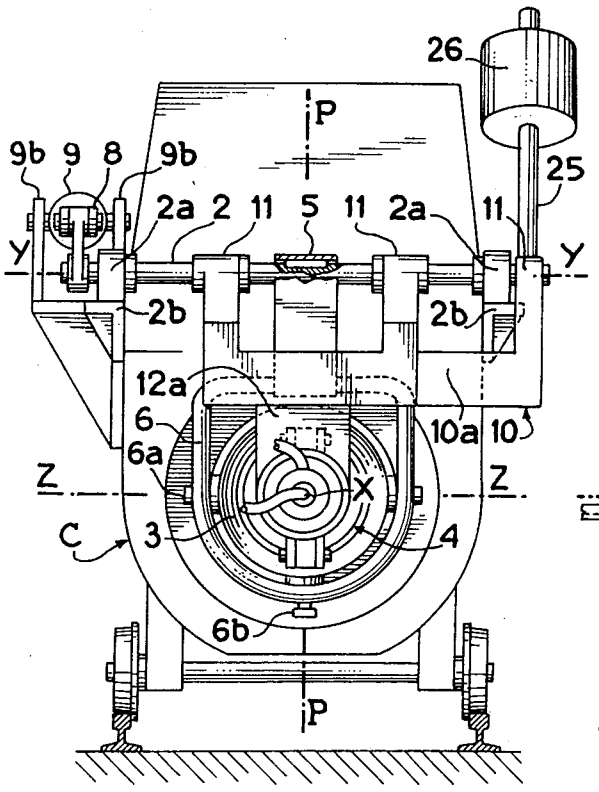
FIG. 2 is a view of the machine shown in FIG. 1 when viewed from the right end of the latter.
Figure 3:
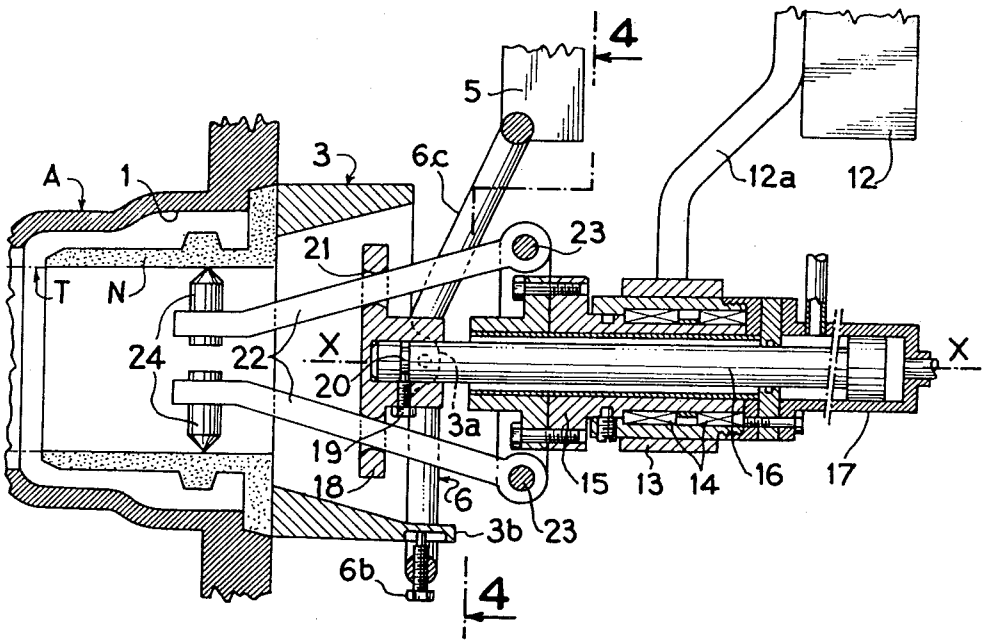
Figure 4:
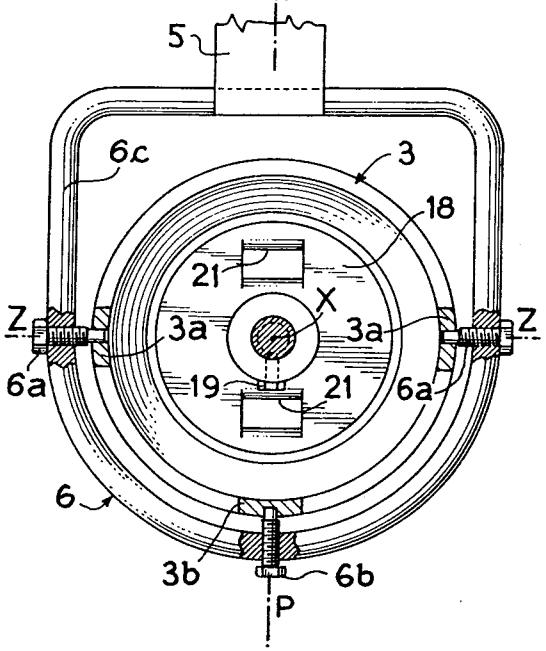
Figure 5:
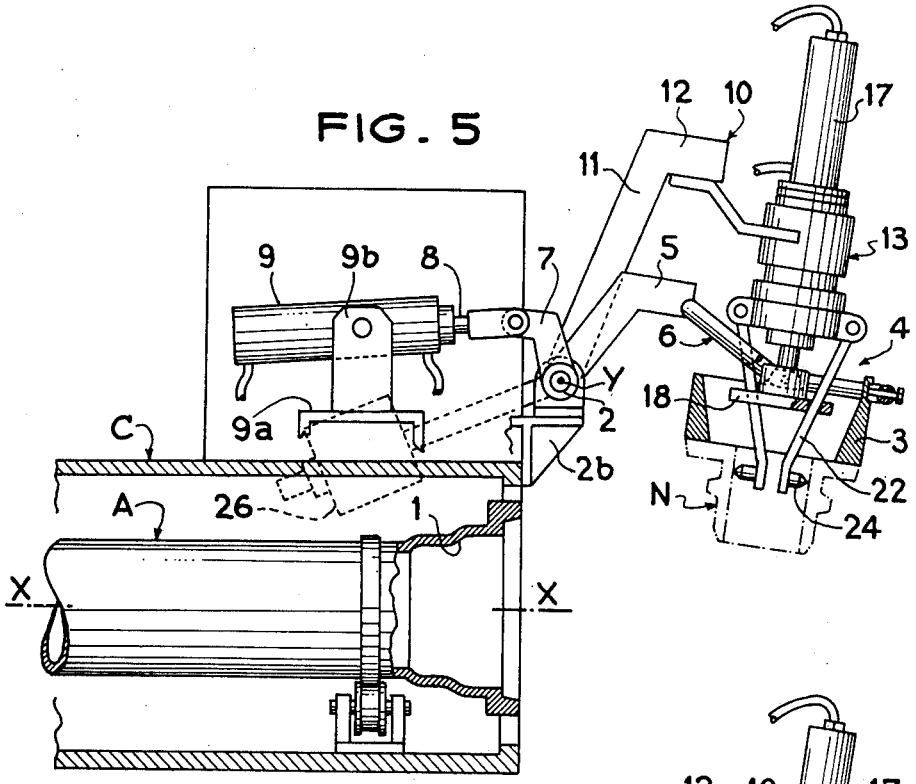
Figure 6:
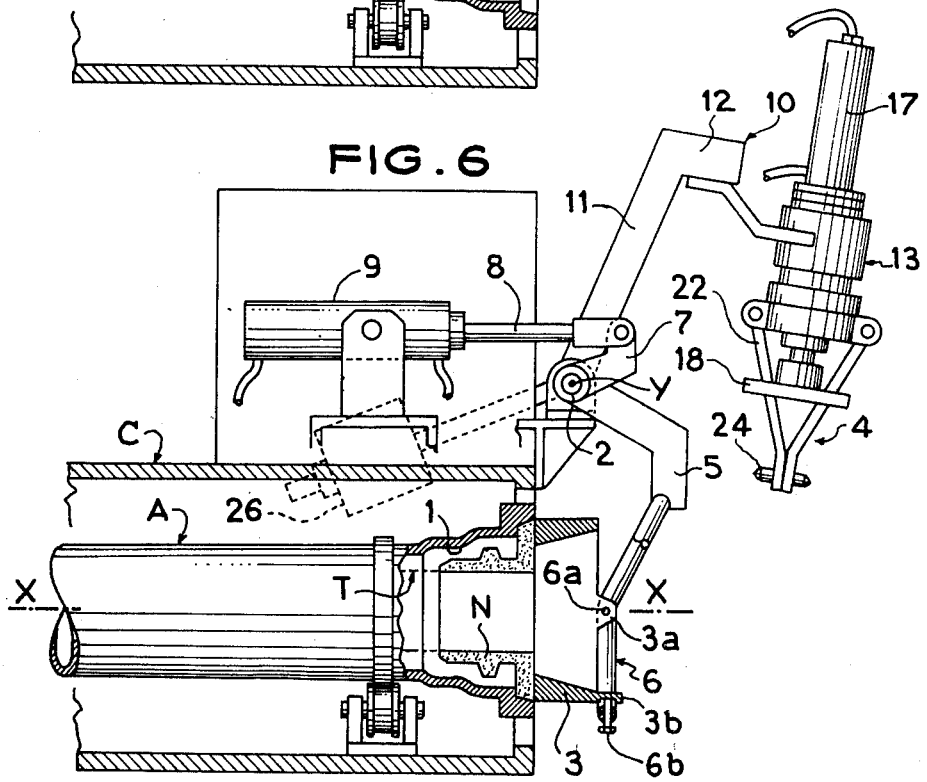
Figure 7:
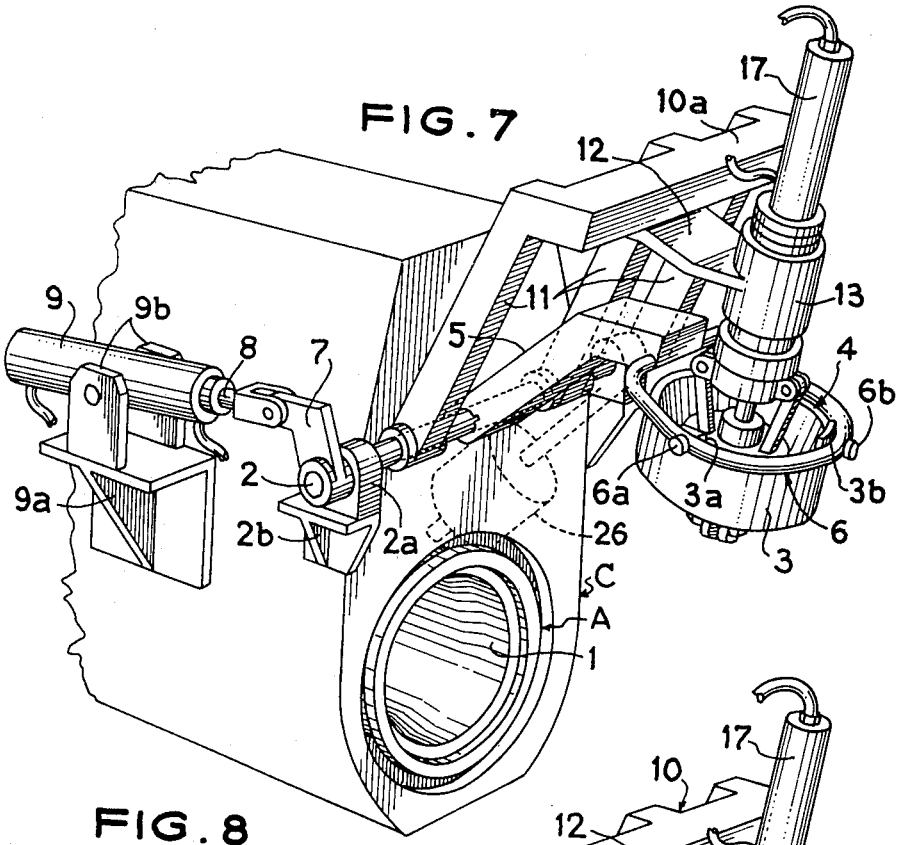
Figure 8:
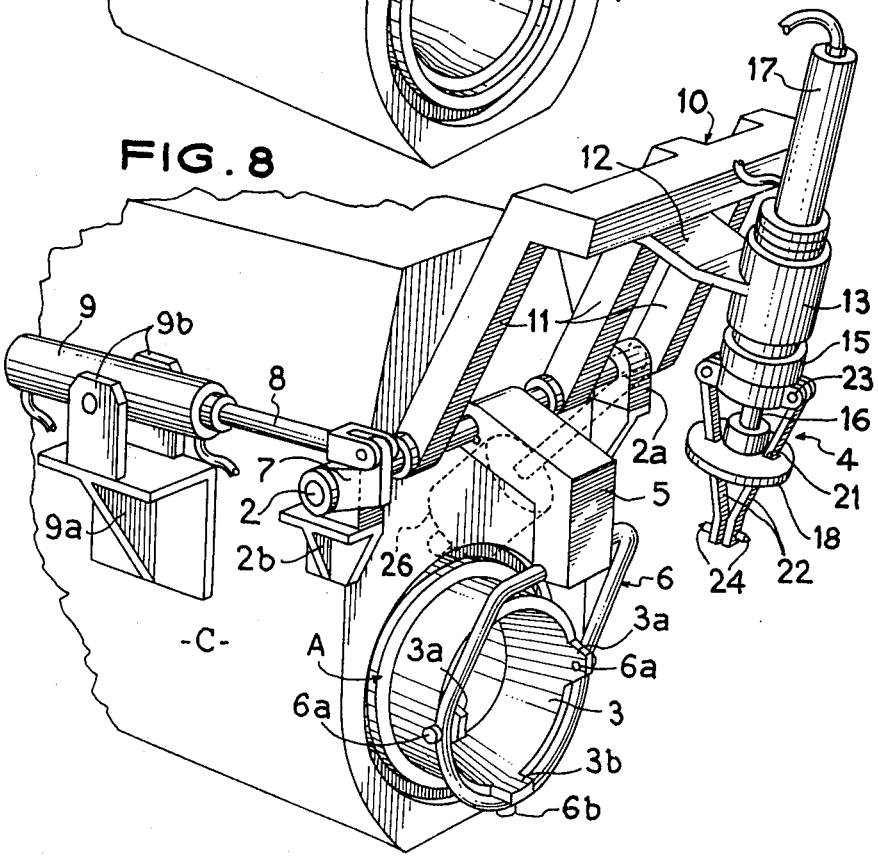

FIGS. 3 and 4 are partial views to an enlarged scale, corresponding to FIGS. 1 and 2, that of FIG. 4 being taken on line 4—4 of FIG. 3;

FIGS. 5 and 6 are views similar to that of FIG. 1 of two other positions of the machine in the course of its operation, and FIGS. 7 and 8 are perspective views of the machine corresponding to the positions shown in FIGS. 5 and 6 respectively.

The illustrated machine is a machine of the Lavaud type that is to say it has a tubular mould A rotatable about its axis X—X, and a pouring channel or trough B, there being a relative movement of translation between the mould and channel so as to enable the pouring channel B to pour the liquid iron throughout the length of the mould 2 during the rotation of the latter. The mould A has adjacent the socket end of the pipe T to be obtained, shown in dot-dash line, a flared bell-shaped cavity in which there must be placed in position a hollow flanged core N which produces the inner shape of the socket of the pipe T.

The machine further comprises a device for axially placing and maintaining the core against the mould, this device being constituted by two pivotal parts both of which are mounted to pivot about a horizontal transverse pivot shaft 2 which has an axis Y—Y and is carried by the housing C of the machine above the socket end 1 of the mould A and slightly beyond the end face of the mould A. The housing C is prevented from rotating. This shaft is journalled in bearings $2^a$ carried on brackets $2^b$ fixed to the housing as shown in FIG. 2. The first pivotal part is an active part pivotable under the action of a jack and comprises a collar 3 for axially thrusting and maintaining the core N against the mould A, this collar 3 having an outside diameter corresponding to that of the flange of the core N against which it must bear. The second pivotal part is a passive part pivotable under the action of the first pivotal part and under the action of a counterweight and comprises tongs 4 having claws for seizing the core N by its inner cavity (FIG. 3).

As shown in FIGS. 1 to 4, the active pivotal part comprises, keyed on the shaft 2 and orientated perpendicular to the latter in a vertical plane P—P containing the axis X—X (FIGS. 4 and 6), an arm 5 carrying a support ring 6 which supports the collar 3 and is symmetrical with respect to the plane P and has a shape and outside dimension which are such that it surrounds both the collar 3 and the tongs 4 which is adapted to be introduced inside this collar and extend therethrough and reach the cavity of the core N. The arm 5 is bent and has an upper portion which is oriented obliquely downwardly from the shaft 2 on the side of the latter opposed to the housing and a vertical lower portion. The collar 3 has a pair of ears $3^a$ which extend axially away from the core N and are diametrally opposed in the horizontal plane of symmetry of the collar, the ears being provided with screwthreaded apertures in which two pivot screws $6^a$ are engaged, the screws being carried radially by the ring 6. On its lower generatrix located in the vertical plane P—P, the collar 3 has a third ear $3^b$ which extends in the same direction as the ears $3^a$ but is longer than the latter, this ear $3^b$ having a slot $3^c$ which is elongated in the direction parallel to the axis X—X and in which there is engaged a movement-limiting screw $6^b$ carried radially by the ring 6 and extending radially in the vertical plane P—P. The radial screws $6^a$ and $6^b$ thus permit an angular movement of the plane containing the front end face of the collar 3 with respect to a vertical transverse plane about a horizontal transverse axis Z—Z of the ears $3^a$ and pivot screws $6^a$ while they prevent rotation of the collar about the axis X—X. The ring 6 does not necessarily have a circular shape but it is essentially curved in such manner as to have an upper portion $6^c$ contained, in the position shown in FIG. 1, in a plane which is oblique with respect to a vertical transverse plane, and lower portion $6^c$ contained in this vertical transverse plane so as to transmit to the collar 3 an axial thrust parallel to the axis X—X from a positive pivoting force exerted through the arm 5 by a jack which will be described hereinunder. The shaft 2 is driven in rotation in both pivotal directions by a cranked lever 7 which is fixed to one of the ends of the shaft 2 on one side of the housing C. Pivoted to one end of the lever 7 is an end 8 of a piston rod of a double-acting jack 9 actuated by fluid under pressure. The body of the jack 9 is carried by the non-rotatable housing C through a bracket $9^a$ and side walls $9^b$ on which the body is pivotally mounted.

The passive pivotal part of the device comprises, freely rotatably mounted on the shaft 2 and therefore independent of the rotations of this shaft, a yoke 10 comprising a horizontal transverse bar $10^a$, three upper arms 11 directly suspended from the shaft 2 but extending obliquely downwardly away from this shaft in a direction away from the adjacent end of the housing 6, and a vertical lower arm 12 from which the tongs 4 is suspended. The tongs comprises a sleeve 13 which is integral with the arm 12 and has its axis coinciding, in the position shown in FIG. 1, with the axis X—X and in which there are disposed coaxially ball or roller bearings 14 carried by a tubular head 15 which is thus rotatable freely inside this sleeve. Mounted inside the head 15 and coaxially with the latter and with a clearance and therefore freely with respect to the head, is a rod 16 of a piston of a double-acting jack whose body 17 is fixed at the end of the sleeve 13 opposed to the mould A. The rod carries at its free end a guide plate 18 which is freely rotatable on the rod owing to the provision of a hollow cylindrical boss on the plate which receives the end of the rod while it is connected to move in translation with the rod, for example owing to the provision of a radial screw 19 screwed in the boss, the end of the screw engaging in a groove 20 of the rod. This plate 18 carries adjacent its periphery apertures 21 through each of which extends a branch 22 which is pivoted at one end 23 to the head 15 and carries at its other end a claw or point 24 which extends radially outwardly.

These clawed branches 22, evenly spaced apart around the axis X—X, constitute a tongs which is expansible or retractable merely by moving the guide plate 18 away from or toward the head 15 by means of the jack 16-17. The yoke 10 is integral with an additional upper arm 25 which is roughly mounted in the extension of one of the arms 11 disposed on one side of the housing C at the end of the shaft 2 opposed to the end which is connected to the jack 9, this arm carrying a counterweight 26 which is adjustable in position thereon and tends to raise the tongs 4 to a withdrawn position with respect to the region in which the tongs is in axial alignment with the mould A.

The machine and device just described operate in the following manner:

When stationary, the jacks 9 and 17 are in their retracted positions so that the collar 3 and the tongs 4 are in the upwardly withdrawn position, their axes are coinciding and the tongs 4 extends through the collar 3 and outwardly orients its claws 24. The latter are withdrawn owing to the fact that the guide plate 18 is moved toward the head 15.

An operator then places a core N on the branches 22 of the tongs until its flange abuts the collar 3. He then actuates the jack 17 whose piston rod 16 urges the guide plate 18 toward the core and moves the branches 22 and therefore the claws 24 apart. These claws thus radially engage the cavity of the core N at points at equal distances from the axis X—X so as to center the core with respect to this axis. The core N is thus held against the collar 3 since the operator has maintained it manually against the collar until the tongs 4 engages the core. The two parts of the device for axially placing and maintaining the core are thus rendered integral through the core N, the latter being moreover in an upwardly withdrawn position with its axis extending downwardly in the position shown in FIG. 5.

As the mould A is driven in rotation about its axis X—X, the pivotable jack 9 is supplied with fluid under pressure $P^1$ in the direction for pivoting the core N toward the cavity 1 of the mould A. The jack 9 actuates the lever 7 which rotates the shaft 2 and pivots downwardly the arm 5, the ring 6, the collar 3 and the core N. The whole of this part pivots in the same movement. The core N, driven along by the collar 3, itself drives the second part constituted by the tongs 4, the yoke 10 with its arms $10^a$ and 11, and the arm 25 with its counterweight 26, the yoke 10 rotating freely on the shaft 2. When the core N enters the end cavity 1 of the mould, it is fitted coaxially therein until its flange abuts the end of its recess, this fitting being obtained exactly owing to the freedom allowed by the possibility of movement of the collar 3 about the pivot screws $6^a$. The assembly is then in the position shown in FIGS. 1 to 4.

At this moment, the core N rotates at the same speed as the mould A and drives in rotation the branches 22, the guide plate 18 and the head 15. The operator then actuates the jack 16-17 of the tongs in the direction for withdrawing the claws 24, the rod 16 moving in the direction for moving the plate 18 toward the body 17 of the jack which causes the claws 24 to move toward the axis X—X and consequently disengage from the core N. The part of the device comprising the tongs 4 is thus released from that comprising the collar 3. Consequently, whereas under the action of the jack 9, still under pressure, this core is maintained applied with force against the core N which is thus locked in the cavity 1, the action of the counterweight 26 on the other hand pivots the yoke 10 and the tongs 4 whose jack 16-17 remains in its retracted position. The assembly is then in the position shown in FIG. 6.

During the subsequent pouring of the iron, while the core N rotates with the mould A, the collar 3 cannot rotate about the axis X—X since it is prevented from doing so by the pivot screws $6^a$ of the support ring 6. Consequently, this collar 3 rubs by its bearing face against the core N.

Before the iron arrives in contact with the core N, there is applied to the jack 9 a fluid pressure $P^2$ higher than the pressure $P^1$ for pivoting so as to overcome the axial thrust of the iron against the core. As soon as the iron appears at the socket, the operator brings about the relative translation between the machine and the pouring channel so as to cause the poured iron to travel along the entire length of the mould from the socket end thereof. When the iron arrives in contact with the core, which then resists its thrust owing to the effect of the collar 3 and jack 9, droplets of iron liable to escape are not driven in rotation since the collar 3 is fixed. Consequently and advantageously, there is a practically complete absence of projections of iron out of the machine. Moreover, owing to the upward withdrawal of the tongs 4 by means of the counterweight 26, there is obtained in a very advantageous manner a complete withdrawal from the central cavity defined by the collar 3 and the core N which permits an excellent view of the arrival of the iron in the socket. This is extremely useful for the initiation of the translation of the machine. Lastly, owing to the fact that the collar 3 is completely disengaged, there is no danger of any vulnerable rotating part coming in contact with the iron.

At the end of the casting of the pipe (or a little before or a little after), in order to permit its extraction, that is to say its stripping from the mould, the pivoting jack 9 is retracted. The collar 3 then returns to its position around the tongs 4 which is already withdrawn upwardly. The assembly of the device is thus once more withdrawn to the position shown in FIG. 5 and is ready to receive a new core N.

It will be observed that the period of operation of the device for placing and maintaining the core is superimposed with respect to time on the periods of actuation of the mould A in translation and in rotation and on the pouring period, and there is therefore not lost time which would otherwise be added to the manufacturing time.

Owing to the mounting on the same shaft 2 of the active pivotal part (arm 5 and collar 3) and of the passive pivotal part (yoke 10 and tongs 4), this tongs 4 is rapidly withdrawn by the counterweight whence a clearance and a good view of the cavity of the mould A near to the socket end thereof, through the collar 3.

Owing to the same arrangement and to the possibility of independent return pivotings on the part of the jack 9 and the counterweight 26, the collar 3 can be mounted in a nonrotating manner with respect to its axis so that there are no projections of droplets of iron by the effect of centrifugal force, which affords increased safety.

Owing to this arrangement, it is the core N which achieves the interconnection between the collar 3 and the tongs 4 in the course of the pivotal movement toward the mould for placing the core and locking it in position.

Owing to the pivotal mounting of the collar 3 on the ring 6 by the pivot screws $6^a$, this ring has possibilities of movement which enable the core N to adapt itself to its recess in the socket of the mould and follow any possible out-of-round of the socket. These movements of the collar 3 are limited by the ear $3^b$ of the collar 3 having a slot $3^c$.

By way of a modification, the shaft around which the pivotal movements are effected may be horizontal but placed below the socket end of the mould or vertical or oblique. Thus, in particular, the shaft may be placed laterally with respect to the machine, the arm 25 being then replaced by an arm on the end of which there is hooked one end of a return spring whose other end is hooked to the housing of the machine. Also by way of a modification, the arm and spring mechanism may be replaced by a mechanism having an arm and return jack or by a toothed sector centered on the axis Y—Y and connected to rotate with the arm 12 and cooperating with a gear driven by a rotate motor (or like mechanism).

I claim:

1. A centrifugal casting machine comprising a housing, an open-ended pouring mould mounted to rotate in the housing about an axis, and a device for axially placing and maintaining a core against the open end of the mould, said device comprising a hollow thrust element, first support means carrying the thrust element and movably mounted relative to the housing so as to permit moving the thrust element between an operative position in which position the hollow thrust element maintains the core against the open end of the mould and allows the inside of the mould to be seen and a withdrawn position in which withdrawn position the thrust element is located laterally to one side of the open end of the mould to allow unhindered access to the open end of the mould, a releasable mechanism capable of engaging the core and holding the core against the thrust element when the the thrust element is in said withdrawn position and while the thrust element moves from said withdrawn position to said operative position, means mounted relative to the housing and connected to the first support means for shifting the thrust element between said operative withdrawn position and said withdrawn position, second support means carrying the releasable mechanism and movably mounted relative to the housing and independent of and movable independently of the first support means and transversely of the mould axis so as to permit moving the releasable mechanism between a first position in which position it holds the core against the thrust element in the operative position of the thrust element and a second position in which second position the mechanism is located laterally to one side of the open end of the mould to allow unhindered access to the open end of the mould and through the hollow thrust element when the thrust element is in said operative position, and returning means connected to the second support means for returning the releasable mechanism to said second position, the releasable mechanism being capable of being disengaged from the core when the thrust element is in said operative position and capable of being thereafter moved by said returning means acting on said second support means from said first position to said second position while the thrust element remains in said operative first position, the mechanism being capable, in moving from said second position to said first position, of following the movement of the thrust element from said withdrawn position to said operative position of the thrust element.

2. A machine as claimed in claim 1, wherein the thrust element is mounted to be held against rotation about the mould axis in the operative position of the thrust element.

3. A machine as claimed in claim 1, wherein the shifting means comprise a double-acting control means for shifting the first support means in either direction.

4. A machine as claimed in claim 1, wherein the thrust element is constituted by a collar having an axis and the releasable mechanism is constituted by a tongs having an axis which is coincident with the axis of the collar when the releasable mechanism is operative to hold the core against the collar, the tongs having claws which are expansible and retractable relative to the axis of the tongs, a double-acting control means being combined with the tongs to expand the claws of the tongs for selectively engaging the core and retract the claws of the tongs for disengaging from the core.

5. A machine as claimed in claim 4, wherein the tongs has branches carrying the claws and the releasable mechanism comprises a part which is non-rotatable relative to the axis of the mould in the first position of the releasable mechanism and includes a body of a jack which constitutes the double-acting control means, and a part which is rotatable relative to the axis of the mould in the first position of the releasable mechanism and carries the branches of the tongs which are mounted on the rotatable part to pivot in radial planes containing the axis of the tongs, the jack having a rod and a plate which plate is movable by the rod and has passages for guiding the branches of the tongs.

6. A centrifugal casting machine comprising a housing, an open-ended pouring mould mounted to rotate in the housing about an axis, and a device for axially placing and maintaining a core against the open end of the mould, said device comprising a hollow thrust element, a releasable mechanism for engaging the core and holding the core against the thrust element, a pivot shaft supported relative to the housing and perpendicular to the axis of rotation of the mould and disposed laterally of said axis of rotation, first support means carrying the thrust element and mounted on the shaft to rotate about the axis of the shaft and second support means independent of the first support means and carrying the releasable mechanism and mounted on the shaft to rotate about the axis of the shaft independently of the first support means, means mounted relative to the housing and connected to the first support means for shifting the thrust element about the shaft axis between an operative position in which position the thrust element maintains the core against the open end of the mould and allows the inside of the mould to be seen and a position in which withdrawn position the thrust element is located laterally to one side of the open end of the mould to allow unhindered access to the open end of the mould, the second support means being rotatable about the shaft axis to move the releasable mechanism between a first position in which first position it is capable of holding the core against the thrust element in the operative position of the thrust element and a second position in which second position the mechanism is located laterally to one side of the open end of the mould to allow unhindered access to the open end of the mould and axially of the mould through the hollow thrust element when the thrust element is in said operative position, and means connected to the second support means for returning the releasable mechanism to said second position, the releasable mechanism being capable of being disengaged from the core when the thrust element is in said operative position and capable of being thereafter moved by the action of said returning means from said first position to said second position while the thrust element remains in said operative position, the mechanism being capable, in moving from said second position to said first position, of following the movement of the thrust element from the withdrawn position to the operative position of the thrust element.

7. A machine as claimed in claim 6, wherein the first support means comprise a ring which surrounds the thrust element and the thrust element is mounted on the ring to be pivotable about a pivot axis which is parallel to said pivot shaft, movement limiting means being interposed between the ring and the thrust element for allowing a limited pivotal movement of the thrust element relative to the ring about said pivot axis.

8. A machine as claimed in claim 6, wherein the shaft is horizontal and the return means is constituted by a counterweight.

9. A centrifugal casting machine comprising a housing, a pouring mould mounted to rotate in the housing about an axis, and a device for axially placing and maintaining a core against the end of the mould, said device comprising an axial thrust element extending along an axis for urging the core against the end of the mould, a releasable mechanism extending along an axis for fixing the core to the thrust element, a pivot shaft supported relative to the housing and perpendicular to the axis of rotation of the mould and disposed laterally of said axis of rotation, first support means carrying the thrust element and rotatably mounted on the shaft and second support means carrying the releasable mechanism and rotatably mounted on the shaft independently of the first support means, shifting means mounted relative to the housing and connected to the second support means for shifting the first support means about the shaft and thereby shifting the thrust element about the shaft between an operative position in which the thrust element urges the core against the mould and a withdrawn position, the second support means being rotatable on the shaft to permit the releasable mechanism to move between a first position in which it fixes the core to the thrust element when the thrust element applies the core against the mould and a second position, and means connected to the second support means for returning the releasable mechanism to said second position by rotation of said second support means, the arrangement being such that the mechanism can follow, in moving between said second position and said first position, the movement of the first support means and the thrust element, said first support means comprising a first arm rotatably mounted on the shaft, the thrust element being mounted on the first arm, and the second support means comprising a second arm freely rotatably mounted on the shaft, the releasable mechanism being mounted on the second arm.

10. A machine as claimed in claim 9, wherein each arm has a centre portion and two end portions extending obliquely from the centre portion, in divergent relation to each other, one of the end portions of each arm extending radially of the shaft and the other end portions of the arms carrying respectively the thrust element and the releasable mechanism, one of the centre portions being perpendicular to the axis of the mould in the operative position of the thrust element and the other centre portion being perpendicular to the axis of the mould in the first position of the releasable mechanism.

* * * * *